United States Patent [19]

Walda et al.

[11] 4,425,064

[45] Jan. 10, 1984

[54] RAILWAY CAR TURNTABLE LOADING SYSTEM

[76] Inventors: Fedde Walda; Nanne M. Walda; Benno F. Walda, all of Leendert Sparreboomstraat 13-15, 3087 JJ Rotterdam, Netherlands

[21] Appl. No.: 169,110

[22] Filed: Jul. 15, 1980

[30] Foreign Application Priority Data

Jul. 25, 1979 [NL] Netherlands ..... 7905753

[51] Int. Cl.[3] ..... B60P 1/00; B60P 3/07; B61D 3/04

[52] U.S. Cl. ..... 410/1; 105/217; 105/455; 414/467

[58] Field of Search ..... 410/1; 414/467, 537; 105/217, 455

[56] References Cited

U.S. PATENT DOCUMENTS

| | | | |
|---|---|---|---|
| 2,246,543 | 6/1941 | Smith | 410/1 |
| 2,821,936 | 2/1958 | Weissman | 410/1 |
| 2,835,209 | 5/1958 | Kavanaugh | 410/1 X |
| 3,019,917 | 2/1962 | Ajero | 410/1 |
| 3,075,479 | 1/1963 | Goby | 410/1 |
| 3,149,583 | 9/1964 | Morrill | 410/1 X |
| 3,490,389 | 1/1970 | Brown | 410/1 X |
| 3,584,584 | 6/1971 | Milenkovic | 410/1 |
| 3,916,799 | 11/1975 | Smith | 410/1 |

*Primary Examiner*—Robert B. Reeves
*Assistant Examiner*—Howard Beltran
*Attorney, Agent, or Firm*—Frishauf, Holtz, Goodman & Woodward

[57] ABSTRACT

A rail car comprises a movable loading floor for use with a pair of platforms of substantially equal height, the platforms being located on respective opposite longitudinal sides of the rail cars for loading and unloading of trailers, motor vans, passenger cars, etc. The rail car has a recessed chassis bottom between the wheeled support trucks thereof, on which is supported the movable loaded floor for carrying and shipping a trailer. The rotatable loading floor is rotatable from a first position in which the longitudinal axis of the rotatable loading floor coincides with the longitudinal axis of the rail car, to a second position in which the longitudinal axis of the rotatable floor is at a given angle relative to the longitudinal axis of the rail car and in which the ends of the rotatable loading floor overlie respective platforms on opposite sides of the rail car. When in the second position, the rail car loading floor is in a position for transferring a trailer relative the rail car by selectively rolling the trailer on or off of the rail car. Hydraulic rams are coupled between the chassis and the wheeled support trucks of the rail car and to the rotating mechanism for the rotatable loading floor for raising the chassis relative to the trucks of the rail car to a height such that the rotatable loading floor is above the height of the platforms before the rotating means can rotate the rotatable loading platform.

16 Claims, 15 Drawing Figures

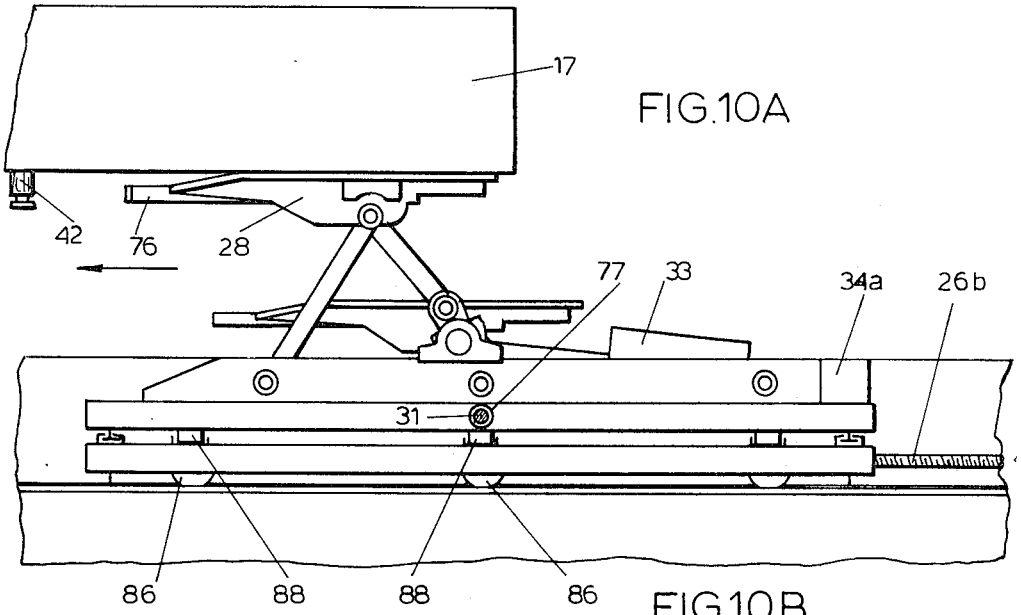
FIG.10A
FIG.10B
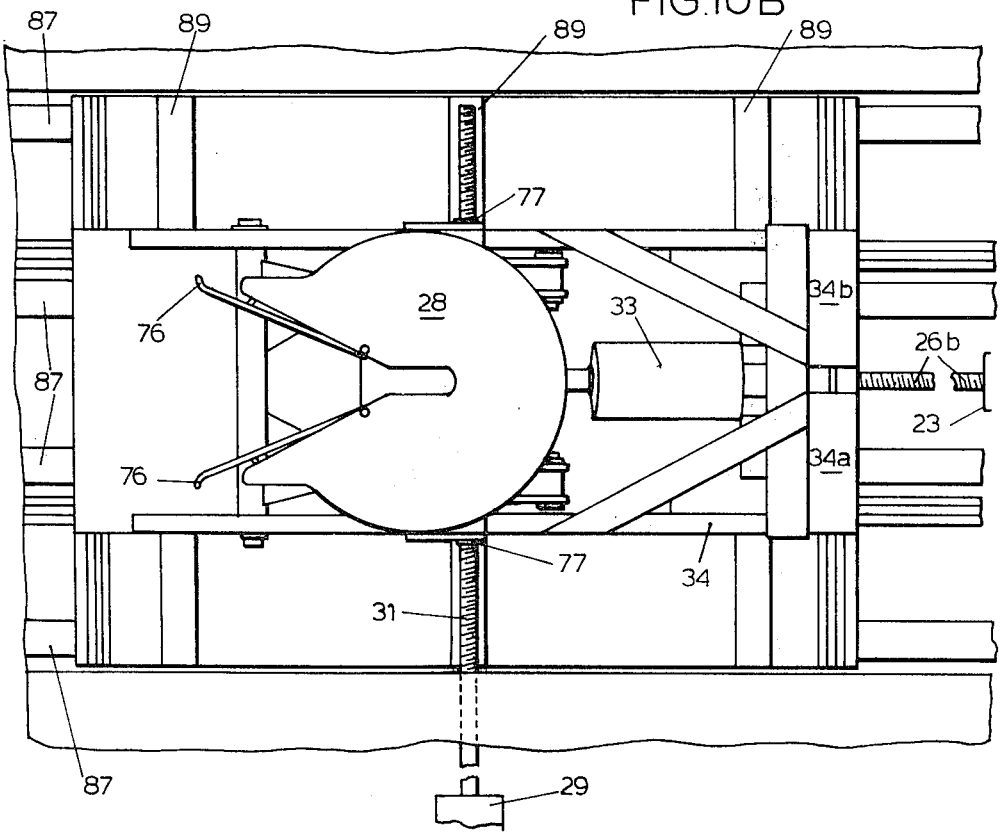

RAILWAY CAR TURNTABLE LOADING SYSTEM

BACKGROUND OF THE INVENTION

The present invention relates to a rail car with a special loading floor and special platform for quick loading and unloading of trailers (forming part of a semi-trailer), motor vans, passenger cars, etc. The rail car has a recessed chassis bottom between fore and aft wheeled trucks, on which is supported a rotatable loading floor.

The invention pertains to a problem in the shipping and transportation industry and has for its object to carry out the transportation of goods, now being done by energy consuming motor vans and tractor-trailers (semi-trailers), instead of by special railway cars and special railway platforms.

SUMMARY OF THE INVENTION

The present invention provides a rail car in which the loading floor is rotatable in a horizontal plane between two positions, viz. a first position in which the longitudinal axis of the rotatable loading floor coincides with the longitudinal axis of the rail car, and a second position, in which it is at an angle thereto. A kingpin coupling is provided to engage a loaded trailer and maintain it in place during shipping of the trailer on the rail car. The trailer is just uncoupled from its truck and maintains therefore, while standing on the loading floor of the deeploader, its own wheel chassis on the rear side while during shipping the trailer's front side is supported by the kingpin coupling. Thus, wagons with rotatable floors offer the solution that they can take over the complete goods-transport that at this moment takes place over the road; that is, from station to station.

In an embodiment of the invention, the rail car has a floor rotating over 360°—or in a simpler construction over about 60°—, and a floor height of 25 cm calculated from the top of the rails. The rotatable floor rotates over the loading and unloading platforms and is driven electrically. Each station with which the rail car of the present invention is used must have special platforms with a height of 25 cm, calculated from the top of the rails. This is less than half of the height of normal platforms.

Preferably all actions in the system of the present invention occur automatically so that railway personnel is not forced to think of all operations in the operating sequence. To this end a switch board is provided on the rail car, including a handle which is connected to an integrated programming switch, which, however, can also be actuated manually by push buttons. The manual operation remains, of course, reserved for the case where malfunctions occur in the electro-hydraulic system carried along the train.

If there is a failure in the electrical supply the rotatable loading floor of the present invention cannot be moved from its place. Therefore, hooks are provided on the rotatable floor, which in the case of emergency, can be engaged and pulled by an external vehicle for causing the floor to rotate.

Further, it is preferable that the loading floor be rendered rigid by a number of longitudinal and transverse beams casting through rollers on a steel slab of the rail car. In this way, the loading floor can rotate in a purely horizontal plane.

BRIEF DESCRIPTION OF THE DRAWINGS

FIGS. 10A and 10B show a side view and a top view, respectively, of the chassis frame of the rail car and of the rotatable floor;

DETAILED DESCRIPTION

Referring to FIGS. 1–5, a discussion of the operation of a system embodying the present invention will be given in connection with a typical time schedule. Throughout the application, the term "semi-trailer" is used to denote a tractor-trailer combination.

Figure 1:
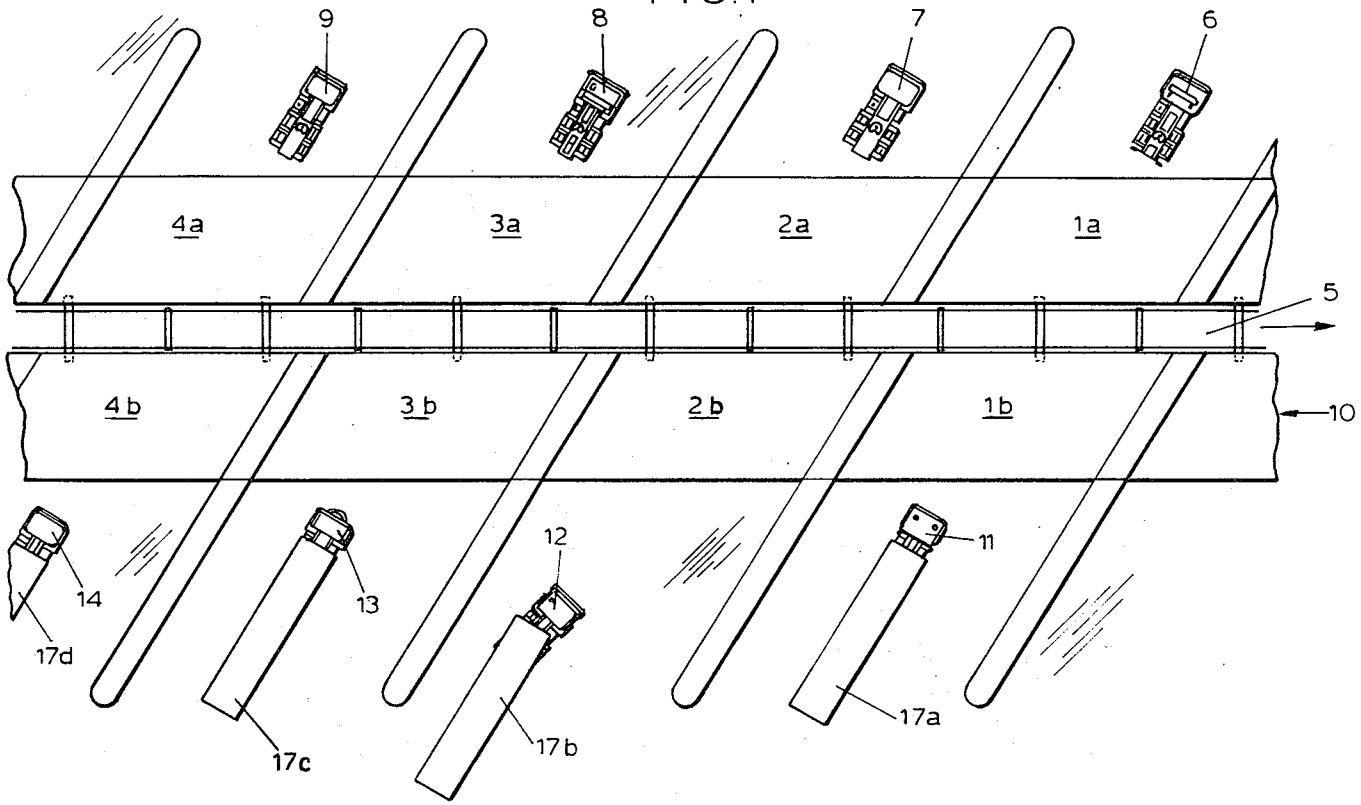
FIGS. 1–5 are top views showing the unloading and loading of trailers (which form part of a semi-trailer or tractor-trailer combination) from or on a train which is comprised of rail cars in accordance with the invention.

FIG. 1 shows at 09:50 o'clock a platform 10 with sections 1*a*, 2*a*, 3*a*, 4*a*, etc. to the left of railway tracks 5, and sections 1*b*, 2*b*, 3*b*, 4*b*, etc. to the right of the railway tracks 5. Four tractors 6–9 in the sections 1*a*, 2*a*, 3*a* and 4*a* are waiting on the left side of the tracks 5 for the train which has to arrive at the platform at 10:00 o'clock. At the same time, likewise at 09:50 o'clock, for example (or earlier) four loaded semi-trailers with tractors 11–14 are waiting on the right side of the trailer 5 in the sections 1*b*, 2*b*, 3*b* and 4*b*. As soon as the first tractors 6–9 have drawn the trailers supplied by the train from the rotatable floor of the rail cars, tractors 11–14 draw new trailers onto the rail cars.

Figure 2:
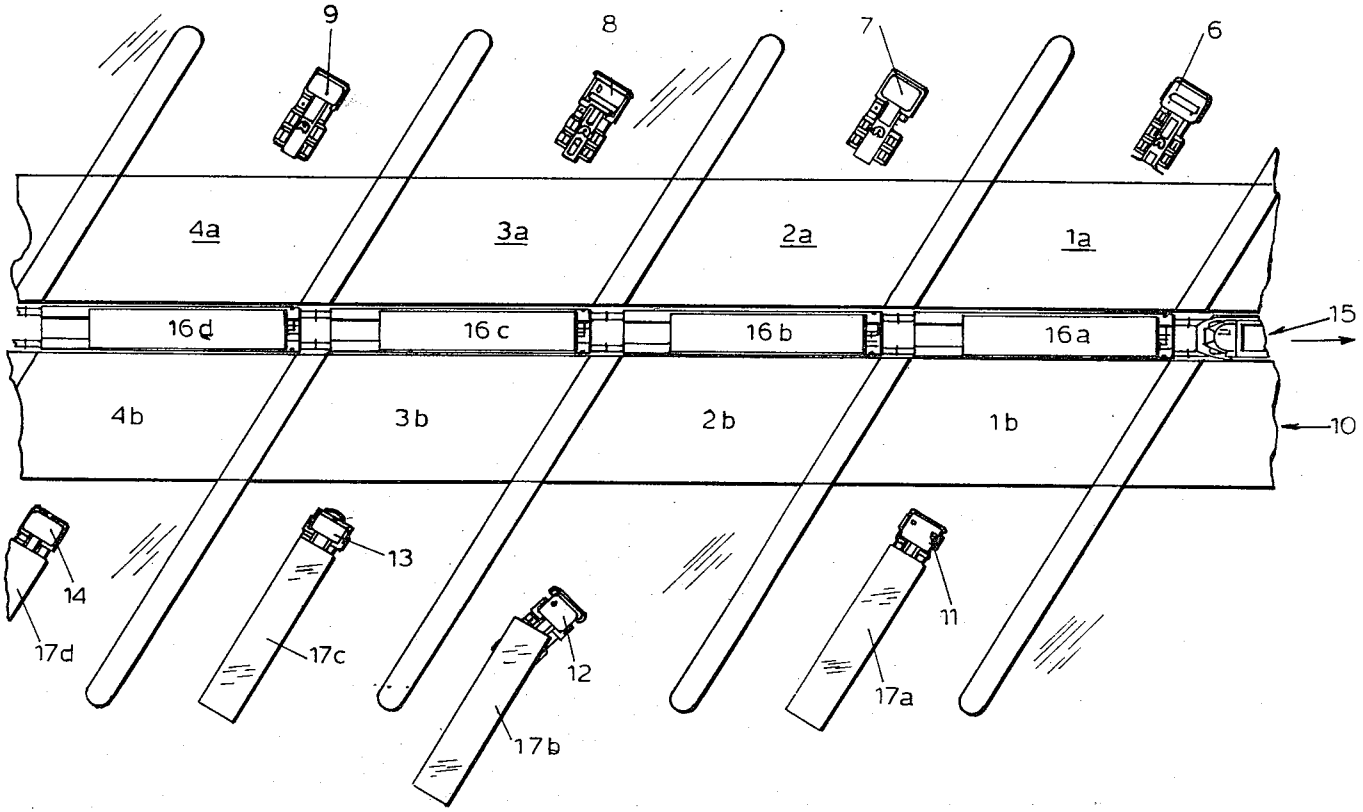

In FIG. 2 a train 15 stops at 10:00 o'clock along the platform 10 at a precisely indicated place. The first tractors 6–9 are ready to start coupling to the trailers 16*a*–16*d*, respectively, which have just arrived so as to draw them off the train 15. The four tractors 11–14 with their respective trailers 17*a*–17*d* etc. to be coveyed standing on the right side are ready to start. When the first tractors 6–9 have drawn the trailer 16*a*–16*d* of the just arrived train 15, tractors 11–14 run their respective trailers 17*a*–17*d* onto the train 15.

Figure 3:
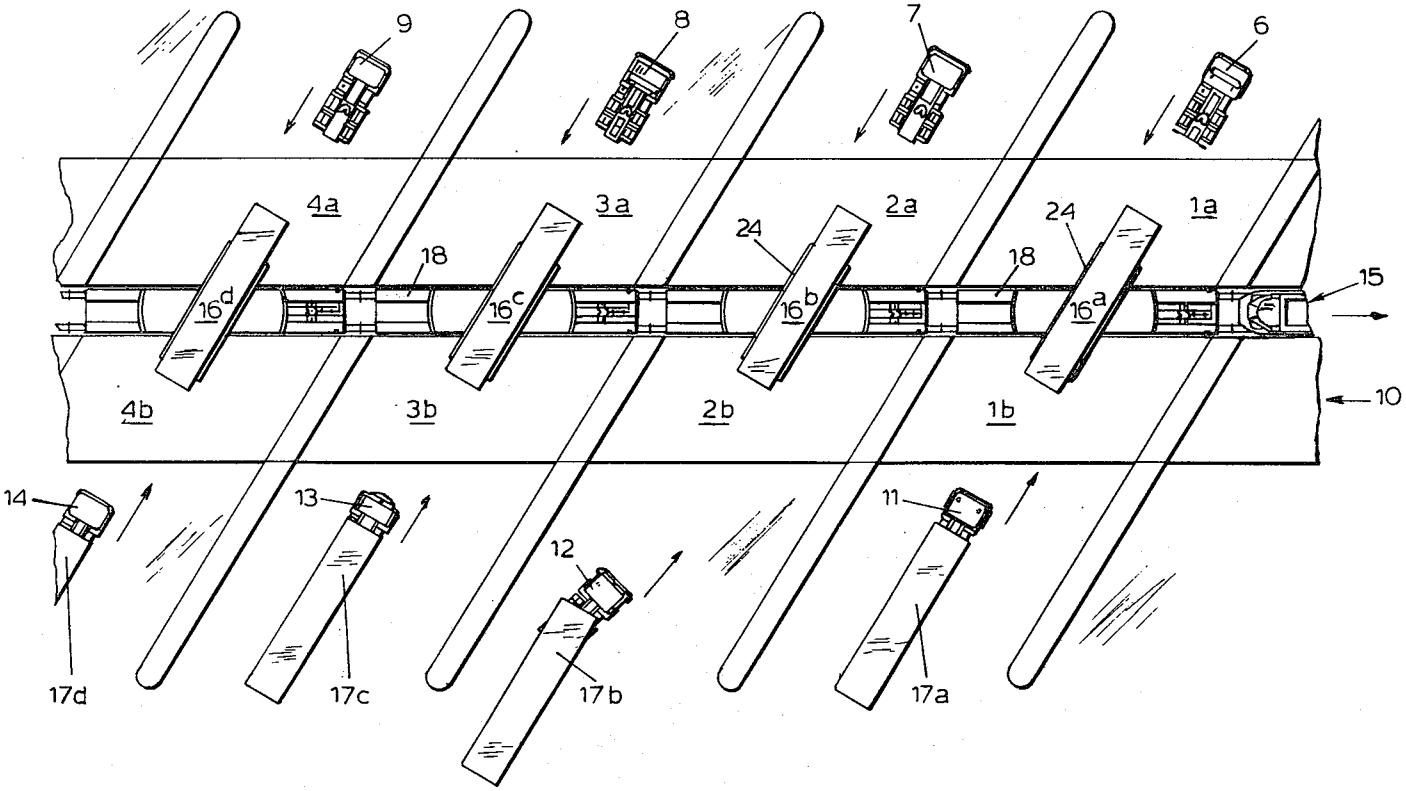
Figure 7:
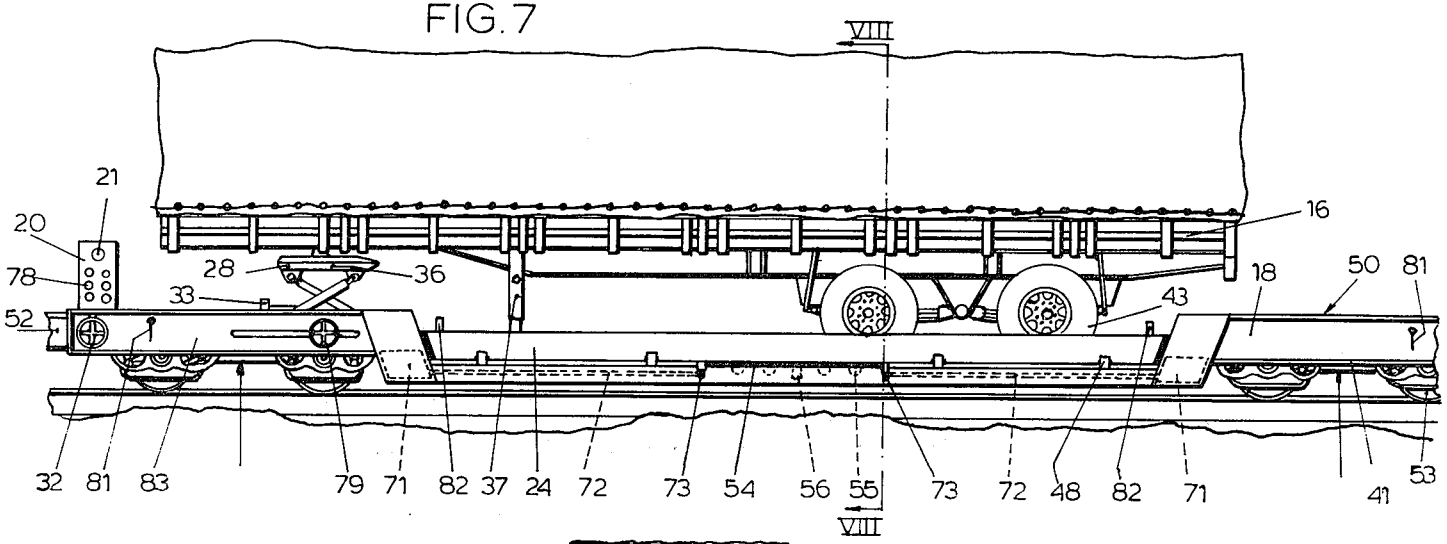
FIG. 7 is an elevational view thereof.

As seen in FIG. 3, immediately after arrival of the train 15, railway employees have operated at 10:05 o'clock as many control members 21 (FIG. 7) as the number of trailers 16*a*–16*d* to be unloaded from the rail cars; in the present case the control members of the 1st, 2nd, 3rd and 4th rail cars 18 are operated. As seen in FIG. 7, the control members 21 are mounted on a control panel 20 on the front side of the rail car 18 on both sides thereof. The control members 21 are connected to an integrated switch, so that these control members, when operated conduct all actions, one after the other, so that the rotatable loading floor 24 is rotated over about 60°, extends on both outwardly of the rail car 18, and rotates over the platform 10 until the center line of the loading floor 24 coincides with the running direction of the waiting tractors 6–9. Tractors 6–9 must move backwards to draw subsequently the respective trailers conveyed by train 15 off the rotatable floors 24. The loading floors 24 are likewise in the same running direction of the aforementioned tractors 11–14 with trailers 17*a*–17*d*. Tractors 11–14 draw their respective trailers onto the rotatable floor 24 of a rail car 18 as soon as the aforementioned tractors 6–9 with trailers 16*a*–16*d* have left the rotatable floor 24.

Figure 4:
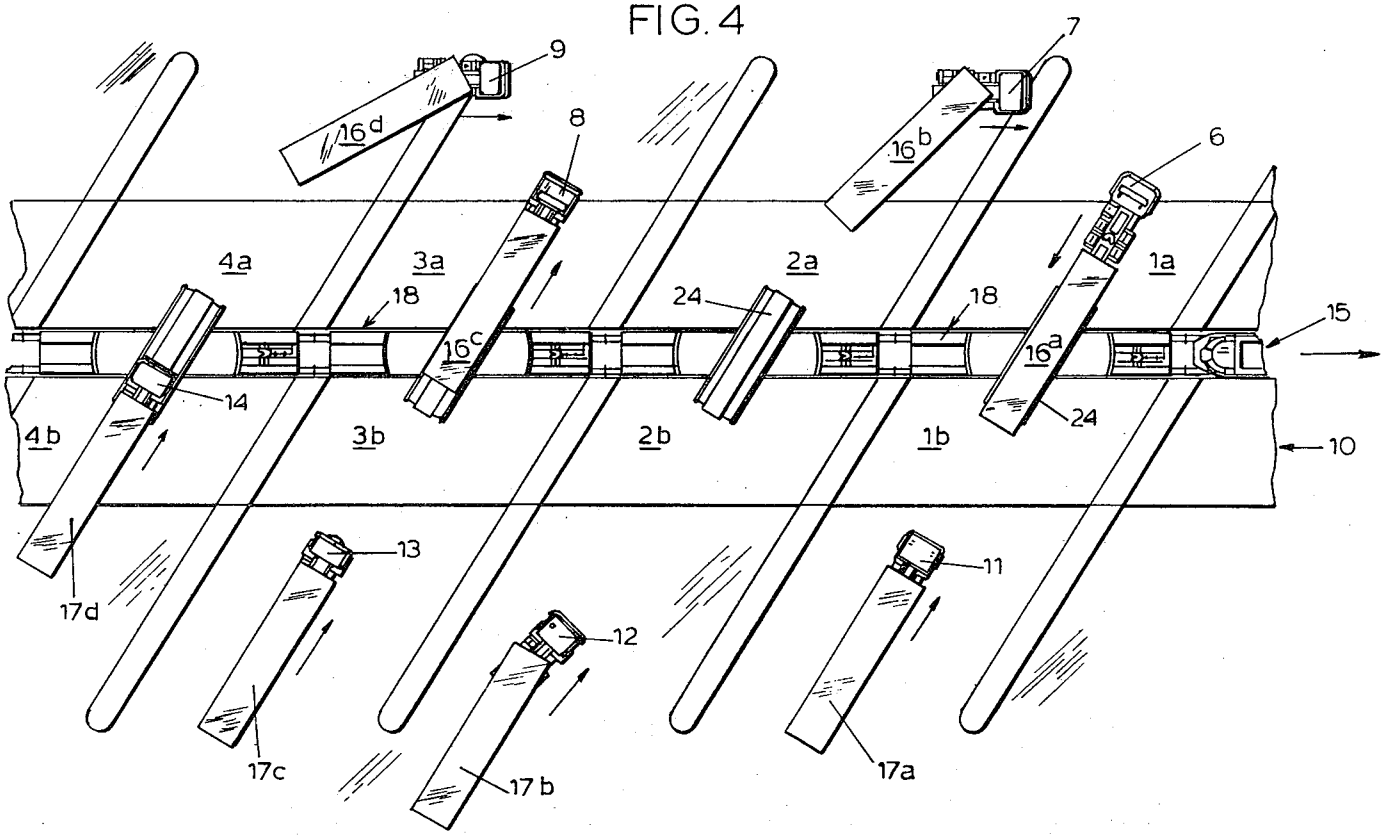

In FIG. 4, showing a top view 5 minutes later, thus at 10:10 o'clock, the rotatable floors 24 are still swung out 60° on both sides over the platforms 10. The drivers of the aforementioned tractors 6–9 move backwards onto the swung out rotatable floors 24, couple the respective trailers to the respective tractors and draw the trailers off the rotatable floor 24, onto the platform 10 so as to unload subsequently the loaded goods in the surroundings of the goods-yard. As soon as the trailers 16 which were supplied by train have been drawn off the rail cars 18, the tractors 11–14 with the respective trailers 17*a*–17*d* to be conveyed, standing-by in the same slanted running direction, immediately draw their trailers 17*a*–17*d* onto the rotatable floors 24 of the rail cars 18, and uncouple the trailers 17*a*–17*d* at the correct place on the rotatable floors 24. Trailers 17*a*–17*d* are to be conveyed by the train 15 elsewhere.

Figure 5:
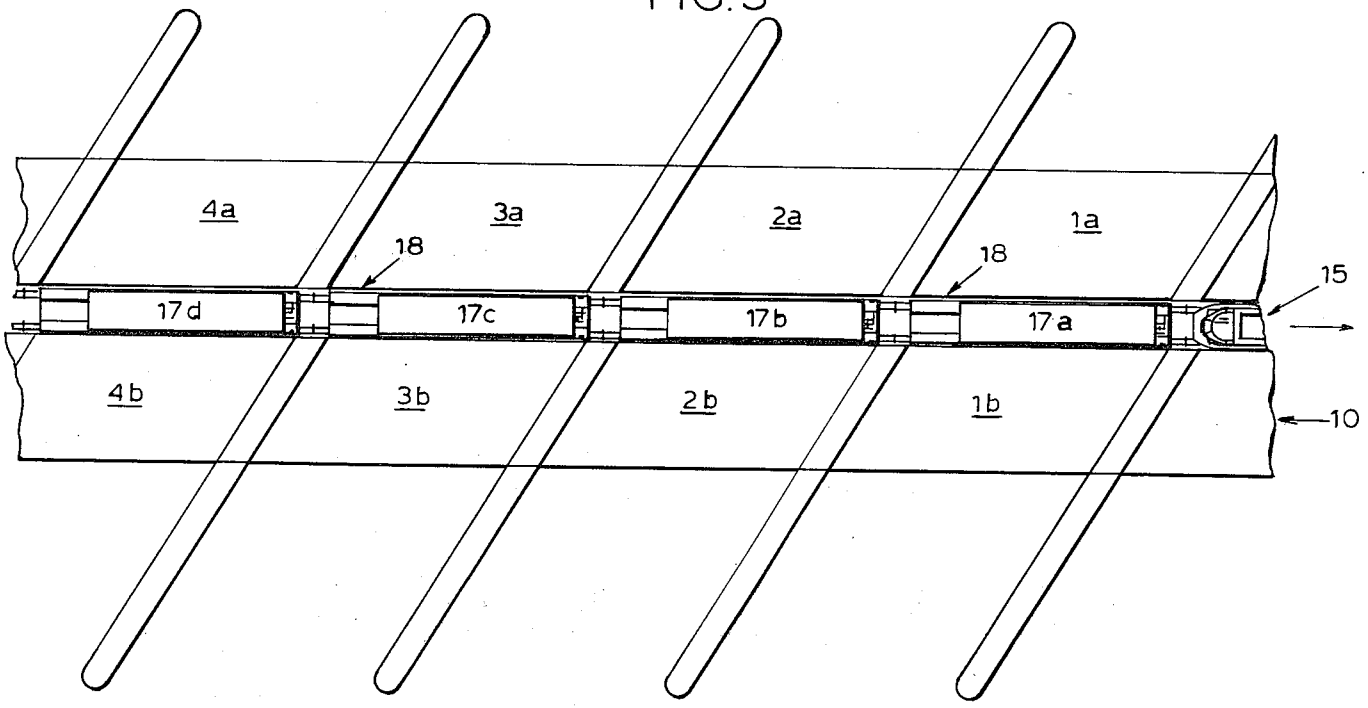

Again, 10 minutes later, thus at 10:20 o'clock in FIG. 5, the railway employees have turned back again the rotatable floors 24 with the trailers 17 thereon into alignment with the rail cars 18 by actuating the aforementioned control members 21 (FIG. 7). When the control members 21 are actuated, the floors 24 rotate automatically back in the reverse direction, and automatically lock themselves completely within a few minutes. The train has had then a delay of ±20 minutes, in which four trailers 16*a*–16*d* have left the train 15 and four new trailers 17*a*–17*d* have been drawn onto the train 15.

If a train 15 with 30 trailers arrives and again departs with 30 new trailers, loading and unloading can be done virtually in the same time, on the condition that exactly as many "collecting" tractors 6–9 are standing by and exactly as many "supplying" tractors 11–14 with coupled trailers are standing by. For those 30 trailers, at least 10 railway employees are needed for operating the control members 21 so as to get all rotatable floors 24 in the swung-out position within 5 minutes and to permit the drivers to draw their trailers from or onto the rotatable floors 24.

Figure 6:
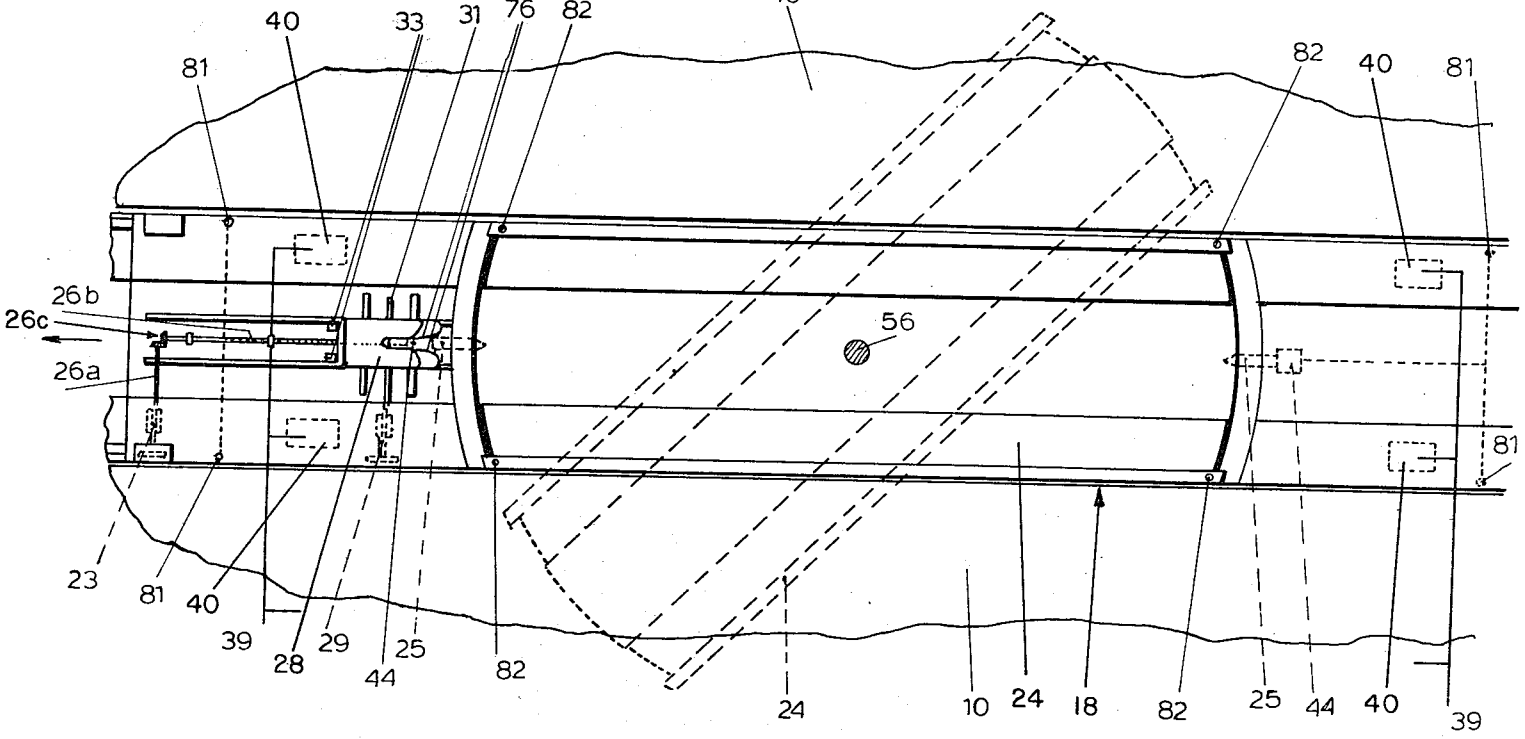
FIG. 6 is a plan view of a rail car according to the invention.

FIG. 6 is a plan view of a rotatable floor 24 on a rail car 18. The rotatable floor 24 is, for example, 8.64 m long and as soon as it is aligned in the longitudinal direction on the rail car 18, it is locked up automatically by clocking pins 25 fore and aft, so that during the rail car's running, the rotatable floor 24 cannot rotate outwards. Reference numeral 23 denotes an electric motor driving square screw spindles 26*a* and 26*b* which are coupled together by gear set 26*c*. Motor 23 can operate both clockwise and counterclockwise. The spindle 26 is inserted through a screw hole and connected to a coupling 28, equivalent to a conventional kingpin coupling which is better seen in FIG. 7. The motor 23 with said screw spindle 26*a*, 26*b* pushes the kingpin coupling 28 forward if the motor turns clockwise. If the motor 23 turns counterclockwise, the coupling 28 is withdrawn by means of the screw spindle 26*a*, 26*b*.

There is also an electric motor 29 driving a screw spindle 31 and pushing the kingpin coupling 28 in the transverse direction to the left (away from motor 29) or drawing it to the right (toward motor 29) as seen in FIG. 6. This motor too can operate both clockwise and counterclockwise, so that, if the trailer 16 in FIG. 7 is not quite in a straight position on the rotatable floor 24, the kingpin coupling 28 can still be coupled to the trailer 16 due to this feature, so that even in an emergency stop the trailer 16 cannot move forward, backward, or sideways. This feature will be discussed further hereinbelow.

Figure 8:
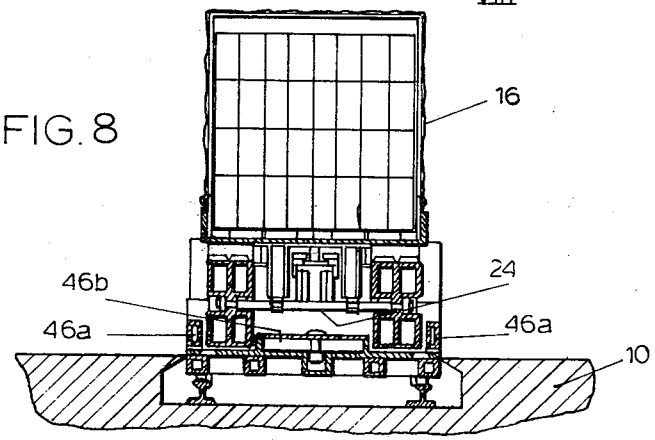
FIG. 8 is a cross-sectional view thereof along the line A—A in FIG. 7.

FIG. 7 is a side view of a rail car 18, preferably with a floor height of 25 cm calculated from the top of the rails. As already mentioned before, the rail car 18 has a rotatable floor 24 which preferably can rotate over 360°, and more restrictedly, is rotatable over at least 60°. On rotatable floor 24 is supported a trailer 16 which is, for example, 12.20 m long, 2.40 m wide and 4.00 m high. Due to the rotatable floor 24 on the rail car, it is possible to unload or load a trailer 16 or 17 (FIGS. 1–5) from and onto the rail car 18 within a few minutes, providing that the rail car 18 is used with the platforms 10 of FIGS. 6 and 8 which are especially built therefor. A complete train of 30 rail cars can be unloaded or loaded by such rotatable floors 24 in 15 to 20 minutes. This has never been possible before in the entire transport and shipping history. The invention will now be described in more detail with reference to FIGS. 6–11.

FIG. 7 shows a hand wheel 32 which is used if the motor 23 of FIG. 6 fails to operate. FIG. 7 further shows a hydraulic king pin coupling 28, actuated electrically, with a double acting cylinder 33. This cylinder 33 can push the kingpin coupling both up and down. As soon as the coupling 28 gets an upward counter pressure of 8 tons, the electro-hydraulic pump 34 (FIGS. 10A and 10B) in the circuit of the cylinder 33 is switched off automatically. The kingpin coupling maintains its counter pressure, even if a safety-latch/blocking latch is unloaded. This occurs as first action at the moment when trailers are being unloaded.

The kingpin coupling 28 is built on the rail car to block the trailer 16 completely, so as to prevent the trailers, during the train's stopping or accelerating or in an emergency-stop, from rolling or sliding forward or backward. This kingpin coupling 28 is also designed to relieve the weight on the front supports 37 (FIG. 7) of the trailer 16. The kingpin coupling 28 works, as described before, electro-hydraulically, and is operated by a handle or control member 21, which is mounted on a switch board 20 on both sides of the rail car 18 at the head end thereof. Handle 21 has only two positions; upwards and downwards, and is operated through an integrated switch. If the handle is in the middle position, everything is switched off. The entire operation during unloading and/or loading of the trailer 16 occurs as follows:

At the moment that a train with 10 to 30 rail cars 18 enters a station and runs along the platform, the first act of the railway personnel is to cast off the safety-latches/blocking latches 36 (FIG. 7) of the trailers 16, which must be unloaded. The second act is to push down the handles 21 (FIG. 7) of the railcars carrying the trailers 16 which have to be taken off the rail cars. These two acts take place within a few minutes.

Hereafter everything goes automatically, as follows:

1. Four electro-hydraulic pumps 40, as shown in FIGS. 6 and 7, start working, which pumps are connected to four HP-cylinders 39, which in turn are mounted adjacent the respective spring mechanism 41 (FIGS. 7, 11 and 12) of the wheeled support trucks of the rail cars for elevating the rail car about 5 to 10 cm out of its springs, so that the rotatable floors 24 can rotate without any trouble. This provides sufficient room (height) over the platform 10, to permit clockwise and counterclockwise rotation of floors 24 over the platform 10 without contacting same. See FIGS. 6 and 8.

2. Next the electro-hydraulic pump 34*a*, 34*b*, shown in FIGS. 10A and 10B, of the kingpin coupling 28 of FIG. 7, is switched-in, taking away the pressure (i.e., about 8 tons) which is still on the coupling after which the coupling 28 sinks to its free position, in which position it remains suspended on the kingpin 42 of the trailer (FIG. 10A).

3. The electric motor 23 of FIG. 6 is now automatically switched in. This withdraws the kingpin coupling 28 by means of the aforementioned screw spindle 26*a*, 26*b*; the kingpin coupling 28 sinks then to the lowest point, so that between the trailer 16 and the coupling 28 a space of 200 mm is provided. The trailer 16 then rests completely free on the rotatable floor 24, i.e., on its fore supports 37 and its rear wheels 43. The rotatable floor can now rotate on the rail car, after the safety-blocking pins 25 in FIG. 6 have been withdrawn out of the rotatable floor.

Figure 9A:
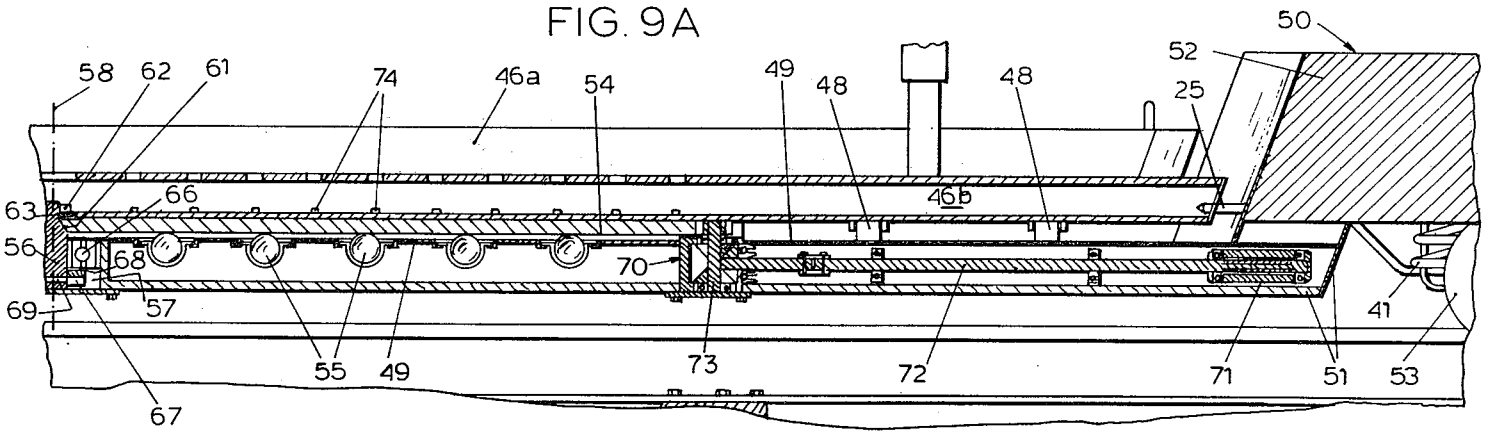
FIGS. 9A and 9B show a detail in an enlarged scale of the trailer dish.
Figure 9B:
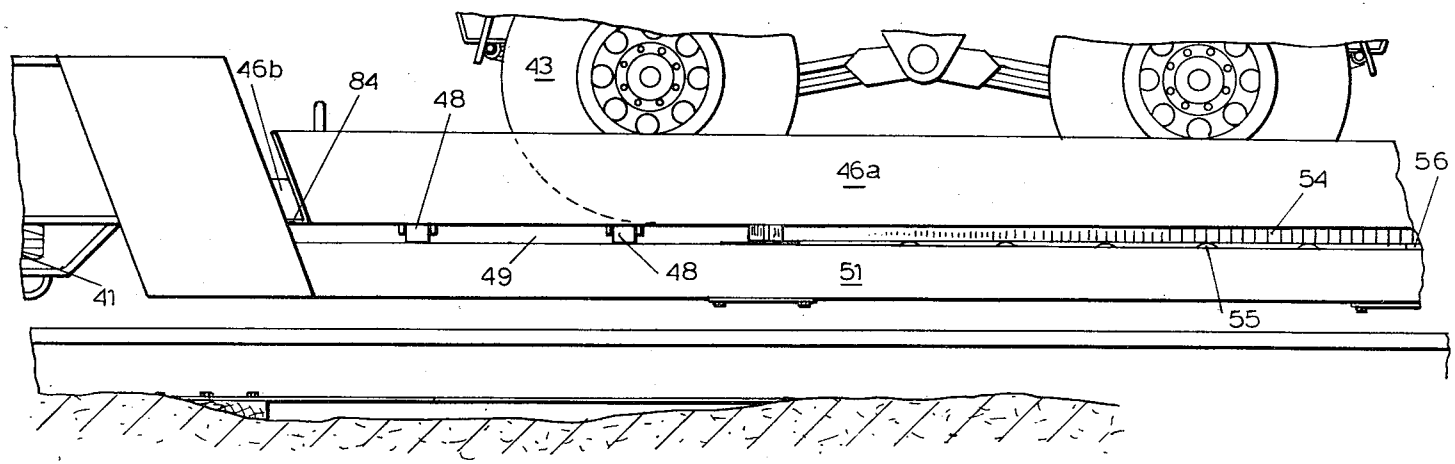

4. An electric motor 44 in FIG. 6 is automatically switched on to unlock the aforementioned blocking pins 25. At this moment the rotatable floor 24 is completely free from the aforementioned blocking pins 25, so that the floor can rotate on the rail car. The longitudinal beams 46*a*, 46*b* of the rotatable floor (see FIGS. 8 and 9) are designed for imparting to the entire floor 24 sufficient carrying capacity and for preventing the rotatable floor 24 from sagging when loaded with a load of up to 40 tons. To this end, 16 steel-rollers 48 with a diameter of 100 mm are provided on the longitudinal beams 46*a*, 46*b*. These steel rollers 48 roll on a completely flat steel slab 49 of 10 mm thickness, which is mounted or welded to the chassis 50 of the rail car 18 over its full length and width (see FIG. 9A). The chassis is comprised of, among other things, a bottom chassis 51 and fore and aft a wheel-track chassis 52 over the wheels 53. As seen in FIGS. 7, 9A and 9B, a steel gear wheel 54 (or ring gear) is mounted to the rotatable floor, having a diameter of 2800 mm and a thickness of 50 mm. The steel gear wheel 54 is supported as seen in FIGS. 9A and 9B, by about 40 rotating balls 55 (which are generally the same type as used in aircraft floors, over which loading palets are to roll). The rotating balls 55, each having a diameter of 100 mm, are partly recessed into the steel slab 49 of the rail car 18 so that its bearing surface 84 projects from the steel slab 49 only a distance of 20 mm+50 mm=70 mm in total. The lower contact surface of the rollers 48 rests upon the steel floor 49 of the rail car 18 and the upper contact surface of the rotating balls 55 engages and supports the underside of the gear wheel 54.

The rotatable floor 24 is maintained in place by an axle 56 having a thickness of 100 mm, which is inserted through a bearing-mounted hole 57 in the center-line 58 of the chassis bottom 51 of the rail car 18. The axle 56 is secured on the upper side of the gear wheel 54, with a tapered bearing surface 61 (FIG. 9A) and clamped by a nut 62 with a washer 63 and locked by a split pin (not shown). The axle 56 projects from below the gear wheel 54 a distance of 120 mm and bears and rotates in a conical ball bearing 66 which is recessed into the floor 49, 51 of the rail car so that the nut 67, with which the entire rotatable loading floor 24 is maintained in place and does not project from below the rail car 18, so it can never get caught on an obstacle.

The axle 56 does not project beyond the nut 67. The nut 67 is held in place with a washer 68 through a (non-visible) slot in the axle 56. A throughbore 69 is bored through the nut 67 and through the axle 56, in which is provided a split pin (not shown). As a consequence, all is locked well and problems can never arise. At the moment when the kingpin coupling 28 (FIG. 10) is in its lowest position and the two safety locking pins 25 in FIG. 6 are unlocked by the fourth step in the operating sequence, the following action takes place:

5. The electric motors 71 (fore and aft) are automatically switched on, FIG. 7. The fore-motor 71 rotates counterclockwise and the aft-motor rotates in the clockwise direction. The motors 71 set the axles 72 (fore and aft, FIG. 9) in rotation; i.e., one axle 72 rotates counterclockwise, and the other axle 72 rotates in the clockwise direction. The other ends of the axles 72 drive, through a transmission mounted in a gear box 70, a small vertical pinion gear 73 that engages with gear wheel 54. The axles 72 are bearing-mounted and the gear wheels 54 and 73 are adjustable. The gear wheel 54 having a diameter of 2800 mm is secured to the rotatable floor 24 with a number of recessed steel balls and therefore, it can easily be substituted in case of wear or in case of fracture, if any.

Figure 11:
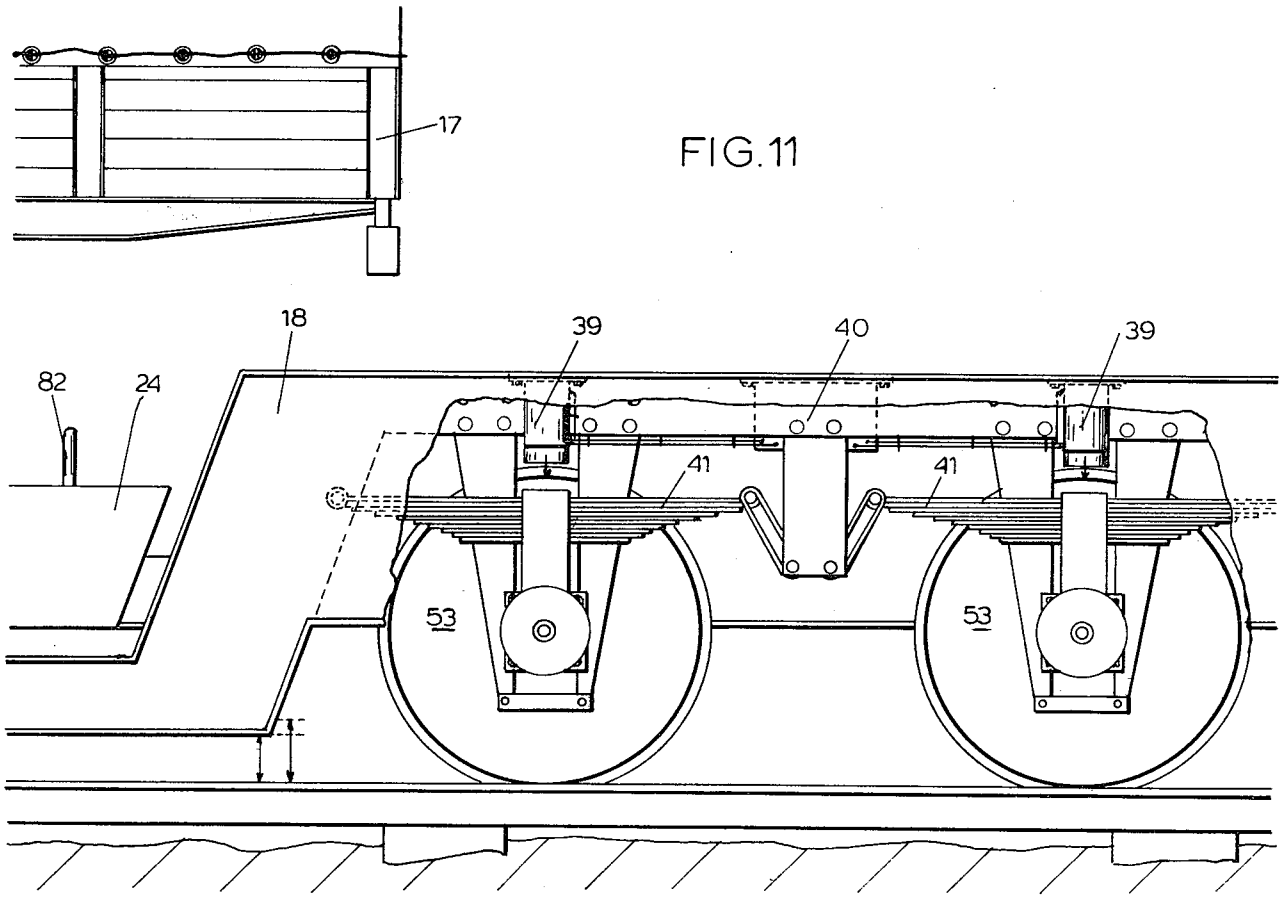
FIG. 11 shows a detail of FIG. 7, in a larger scale, of the right hand bottom portion thereof.
Figure 12:
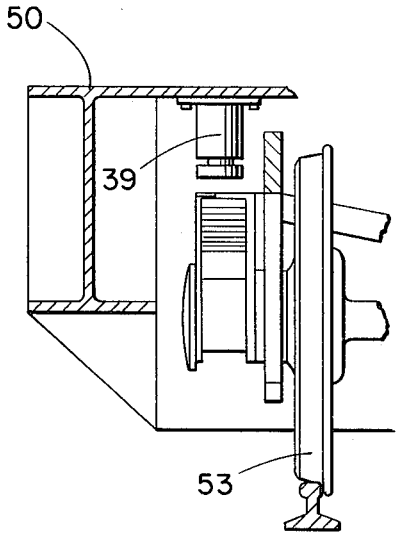
FIG. 12 shows a detail of the rail car raising mechanism.

The underside of the gear wheel 54 is completely flat and is supported on the rotating balls 55, which project from the fixed floor 49, 51 of the rail car 18 a distance of 20 mm. Due to these rotating balls 55 and the 16 aforementioned rollers 48, the rotatable floor 24 loaded with a 40 tons trailer can easily rotate over the floor 49, 51 of the rail car 18 and over the platforms 10 of FIGS. 6 and 8. As soon as the rotatable floor 24 is swung out over 60° beyond the longitudinal axis of the rail car 18, i.e., the leading end is on the left side and the trailing end is on the right side, the 6th and last action occurs:

6. The electro-hydraulic motors 38, FIGS. 7 and 11, are automatically switched on, and the pressure of the HP cylinders 39 is gradually reduced so that the chassis is lowered and the rotatable floor 24 slowly sinks on the platform 10 in FIGS. 6 and 8 on the left side and on the right side. the control member (handle) 21 in FIG. 7 jumps thereafter automatically to the middle position of the control board 20 to turn everything off.

The drivers of the tractors 6–9 in FIGS. 1, 2, 3 and 4 get a signal to move their tractors backward to the rotatable floor and to couple to the respective trailers 16*a*–16*d*. They draw these trailers within a few minutes off the rotatable floors. When the rear wheels 43 of said trailers 16*a*–16*d* are still on the rotatable floors 24, the drivers of the trailer 17*a*–17*d* to be conveyed, move their tractors 11–14 in FIGS. 1, 2, 3 and 4, onto the respective rotatable floors 24 and uncouple same within a few minutes. Immediately thereafter, as already described before, the railway employees put the control members (handles) 21 from the intermediate position to the upper position, whereafter the same actions 1–6 described above occur, but in the reverse order. While the floors 24 are rotating back, one additional action has to occur, as described below.

As soon as a trailer 17 is completely aligned with the center line of the rail car 18, i.e., when the rotatable floor 24 is latched again by locking pins 25, and when the hydraulic kingpin coupling 28 in FIGS. 10A and 10B is pressed in the first position from below against the trailer 17 with a counter-pressure of ±100 kg and when the motor 23 pushes the kingpin coupling 28 backwards over rollers 86, tracking in four longitudinal rails 87, the coupling will slide between the kingpin 42 of the trailer. However, if the trailer 17 had not been put quite straight on the rotatable floor 24, the above pin 42 would not slide into the middle of the kinping coupling 28. Therefore, the kingpin coupling 28 is on its front side provided with two sliding switches 76, on the left side and on the right side, respectively which can cause the electric motor 29 in FIGS. 6 and 9B to rotate counterclockwise or clockwise. While this is going on, the coupling 28 is moved by screw spindle 31 in the transverse direction over rollers 88, tracking in three transverse rollers 89 (FIG. 10B). The motor 29 drives a screw spindle 31, inserted through a screw hole 77 and secured to the kingpin coupling 28. By this mechanism it is possible to move the kingpin coupling 28 a distance of 10 cm to the left or the same distance to the right and to let it seek automatically its correct position itself and to let it slip in the kingpin 42. If the kingpin 28 is in the correct position under the trailer 17, thus in engagement with the pin 42, then the coupling, as already described, is electro-hydraulically pushed upwards till it obtains a counter-pressure of about 8 tons, whereafter the electric-motor 29 is switched off.

This automatic correction facility for misalignment of the kingpin 42 with the kingpin coupling 28 is very important, notwithstanding the possibility to block the trailer, because otherwise the front supports of the trailer would give, and consequently would extend beyond the train which could cause great damage during the train's running.

The kingpin coupling latches/blocking latches 36 are pressed in their latching position by the railway personnel and the trailers 17 are now completely blocked as already described before.

Figure 13:
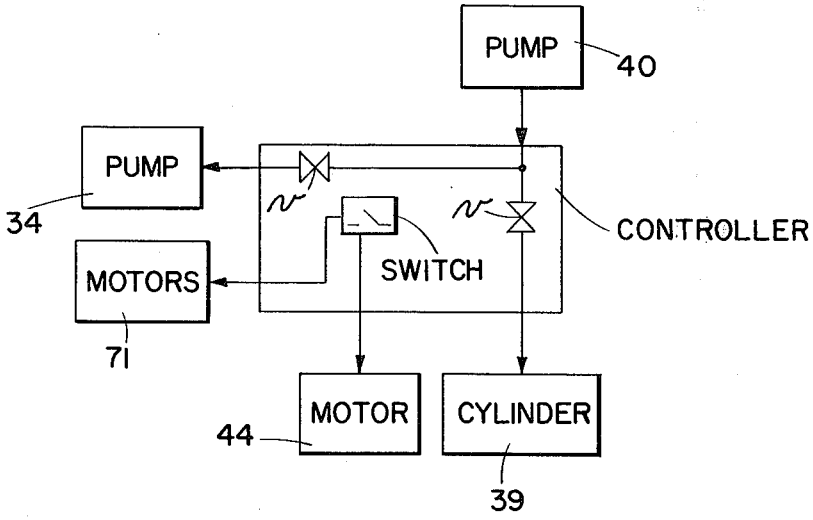
FIG. 13 shows a simplified hydraulic circuit.

On the switch board 20 there are as many push buttons 78 as actions have to be taken. If a failure occurs in the integrated switch, so that it could not be used, then it is possible to switch over to manual operation. Even if there would occur a failure in the supply of electrical power, everything can be manually operated by having the rotatable floors 24 drawn inward or outward by external vehicles through the intermediary of hooks 82 (see FIGS. 7 and 11) secured to the rotatable floors 24, while operating hand wheel 32 and 79 in FIG. 7 and handle 81 in FIGS. 6 and 7. The hydraulic part of the system is in case of electrical power failure operated by a movable diesel-hydraulic pump which is kept stand-by on the loading or unloading platforms, which pump can be connected to the rail cars with a quick closing attachment by means of a high pressure fitting 83 (FIG. 7) on both sides of the rail car 18. A simplified hydraulic circuit is shown in FIG. 13 which comprises a controller with valves "v" therein for controlling the various functions of the system.

Of course, in case of such an electrical power failure, a train encounters a considerable delay. However, the entire system has been designed such that failures are unlikely, and even when they would occur, the trailers can still be unloaded or loaded means of manual operation.

The components 23, 25, 28, 29, 33, 34, 36, 39, 40, 44, 71 in FIGS. 6, 7, 11 and 12 which are operated electrically or electro-hydraulically can also be actuated pneumatically. The pneumatic pressure is about 10 atm. over the entire train. This pressure is supplied by the compressor of the locomotive. Should this, for whatever reason, be impossible, then during the unloading or loading processes of the trailers, the trains may be connected to a source of compressed air available at the railway terminal. The components 21 and 78 in FIG. 7 are thus converted to an integrated time-signal oscillator (i.e., a clock) which conducts all actions one after the other by means of HP valves/switches.

We claim:

1. In a rail car (18) having a movable loading floor for use with a pair of platforms of substantially equal height and located on respective opposite longitudinal sides of said rail cars for loading and unloading of vehicles, and further having a recessed chassis bottom between fore and aft wheeled support trucks, on which is supported the movable loading floor for carrying and shipping a vehicle (16), the improvement comprising:

an elongated rotatable loading floor (24) having ends and which is rotatable mounted at a substantially central portion thereof, between said ends, to the rail car chassis, said rotatable loading floor being rotatable relative to said rail car chassis in a substantially horizontal plane over a given angle between first and second positions, said first position being a position in which the longitudinal axis of the rotatable loading floor coincides with the longitudinal axis of the rail car (18), and said second position being a position in which the longitudinal axis of the rotatable loading floor is at said given angle with the longitudinal axis of the rail car and in which the ends of said rotatable loading floor overlie respective platforms on said opposite sides of the rail car, said rotatable loading floor when in said second position being in operative association with a respective platform on each opposite side of the rail car for transferring a vehicle relative to the rail car;

said platforms having a height which substantially corresponds to the height of said rotatable loading floor when it is in its said second position to permit selective rolling of a vehicle between said rotatable loading floor and said platforms;

means for rotating said rotatable loading floor from said first position to said second position and vice versa; and hydraulic ram means (39) coupled between said rail car chassis and the wheeled support trucks of the rail car and to said rotating means for raising said rail car chassis relative to said wheeled support trucks of the rail car to a height whereat said rotatable loading floor is above the height of said platforms before said rotating means can rotate said rotatable loading platform.

2. The rail car of claim 1, wherein said wheeled support trucks of said rail car comprise in total eight wheels, and wherein said hydraulic ram means (39) comprises eight hydraulic rams operatively associated with each respective wheel.

3. The rail car of claim 1 or 2, wherein said rotatable loading floor is rotatably mounted at substantially a central portion of the rail car chassis so as to be rotatable about said central portion of said rail car chassis.

4. The rail car of claim 1 or 2, wherein said rotatable loading floor (24) comprises a plurality of safety blocking pins (25) selectively coupled to said rail car chassis for fixing the position of said loading floor (24) with respect to said rail car chassis.

5. The rail car of claim 1 or 2, further comprising a switch board (20) located on the chassis of the rail car, said switch board (20) including a handle (21) connected to an integrated programming switch (22), and manually operable push buttons for actuating said programming switch (22) to sequentially cause raising of said chassis by said hydraulic ram means so that said loading floor is above the level of said platforms, rotating of said loading floor to said second position and lowering of said chassis by said hydraulic ram means to cause said loading floor to contact said platforms.

6. The rail car of claim 1 or 2, comprising hooks (82) on said rotatable loading floor (24), which in case of emergency, can be engaged and pulled by a tractor for causing said rotatable loading floor (24) to rotate.

7. The rail car of any one of claims 1 or 2, further comprising a steel slab (49) on the upper surface of a chassis bottom (51) of the rail car; a plurality of steel balls (55) received in recesses in the middle portion of said steel slab; a horizontal ring gear (54) supported by said balls (55) and being mounted below said rotatable floor (24), said rotatable floor (24) resting on said gear (54).

8. The rail car of claim 7, wherein said rotatable loading floor (24) comprises a plurality of longitudinal and transverse beams (46) resting through rollers (48) on said steel slab (49) to render said rotatable loading floor (24) more rigid.

9. The rail car of claim 1 or 2, comprising means coupled to said hydraulic ram means and to said rotating means for lowering said rotatable loading floor by means of lowering said hydraulic ram means after said rotating means has rotated said rotatable loading platform to said second position so that at least said ends of said rotatable loading floor contact said respective platforms on each opposite side of the rail car so that said rotatable loading floor engages said platforms during said transfer of a vehicle relative to said rail car, said engagement of said platform by said rotatable loading floor preventing movement of said rotatable loading floor relative to said platform during said transferring of said vehicle.

10. The rail car of claim 1 or 2, wherein said wheeled support trucks comprise a spring-suspension mechanism (41) between said rail car chassis and the wheels of said trucks and wherein said hydraulic ram means comprises a plurality of high pressure cylinders (39) with associated hydraulic pumps (40) coupled with said spring mechanism (41) and engageable between said wheels and chassis for lifting said chassis over a given height out of the springs of said spring suspension (41).

11. The rail car of claim 1 or 2, wherein:

said wheeled support trucks comprise a spring-suspension mechanism (41) between said rail car chassis and the wheels of said trucks; and said hydraulic ram means comprises a plurality of hydraulic rams (39) associated with respective wheels of said wheeled support trucks of the rail car, said hydraulic rams being mounted on said chassis and being of the double-acting type; electric/hydraulic pumps (40) coupled to said hydraulic rams (39) for lifting said rail car chassis out of said springs prior to rotating of said rotatable loading floor to said second position so that said rotatable loading floor can rotate to said second position free of contact with said platforms; means for relieving the fluid pressure in said hydraulic rams (39) after said rotatable loading floor has been turned to said second position to permit said rotatable loading floor to sink to the platforms on said respective opposite sides of said rail car, after which a vehicle may be transferred relative to said loading platform; means for pressurizing said hydraulic means (39) to lift said chassis and said rotatable loading floor relative to said wheels after loading of said rotatable loading floor; said loaded rotatable loading floors then be rotated back by said rotating means to said first position, and said hydraulic pressure in said hydraulic rams then being relieved by said pressure relieving means to lower said chassis relative to said wheels and into said spring mechanism.

12. The rail car of claim 1, further comprising a king pin coupling means (28) movably mounted to said chassis of the rail car and including a pump (34) which imparts a counter pressure to the king pin coupling means (28) during shipping of the vehicle (16) on the rail car (18), and releases said counter pressure during vehicle transferring.

13. The rail car of claim 12, wherein said king pin coupling means (28) cooperatively engages a king pin (42) of a vehicle such that after release of the counter pressure said king pin coupling means (28) collapses and returns to its free position, and at the same time remains suspended from said king pin (42).

14. The rail car of claim 13, wherein said king pin coupling means (28) includes a motor (23), said motor (23), after release of the counter pressure, withdrawing said king pin coupling means (28) off said king pin (42) so that said king pin coupling means (28) reaches its lowermost position.

15. The rail car of claim 13 or 14, wherein said king pin coupling means (28) is cooperatively coupled with an electromotor (29) and is provided on a front side thereof with two sliding switches (76) which control movement of said king pin coupling means (28) such that said king pin coupling means while being moved to seek a correct position, engages said king pin (42), said switches being engageable with said king pin (42) to control movement of said king pin coupling means (28) so that any deviation of a straight line of the vehicle on the rotatable loading floor (24) is corrected.

16. The rail car of claim 13 or 14, wherein said king pin coupling means (28) is movable to an up-jacked position and comprises a safety/blocking latch (36) for locking same in said up-jacked position.

* * * * *